US010819016B2

(12) United States Patent
Zhu et al.

(10) Patent No.: US 10,819,016 B2
(45) Date of Patent: Oct. 27, 2020

(54) ANTENNA SYSTEM AND MOBILE TERMINAL

(71) Applicant: AAC Technologies Pte. Ltd., Singapore (SG)

(72) Inventors: Zhimin Zhu, Shenzhen (CN); Xiaoyue Xia, Shenzhen (CN); Wei Zhao, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,580

(22) Filed: Jul. 30, 2019

(65) Prior Publication Data

US 2020/0052382 A1 Feb. 13, 2020

(30) Foreign Application Priority Data

Aug. 12, 2018 (CN) ..... 2018 1 0912502

(51) Int. Cl.

| | |
|---|---|
| ***H01Q 13/02*** | (2006.01) |
| ***H01Q 1/24*** | (2006.01) |
| ***H01Q 5/328*** | (2015.01) |
| ***H01Q 1/38*** | (2006.01) |
| ***H01Q 9/26*** | (2006.01) |

(52) U.S. Cl.

CPC ..... *H01Q 1/243* (2013.01); *H01Q 1/38* (2013.01); *H01Q 5/328* (2015.01); *H01Q 9/26* (2013.01)

(58) Field of Classification Search

CPC ..... H01Q 1/12; H01Q 1/241; H01Q 1/247; H01Q 1/248; H01Q 1/243; H01Q 1/38; H01Q 5/328; H01Q 9/26; H01Q 21/0043; H01Q 21/0056; H01Q 21/06; H01Q 21/064; H01Q 13/02; H01Q 13/0233; H01Q 13/06; H01P 3/121

See application file for complete search history.

(56) References Cited

U.S. PATENT DOCUMENTS

2017/0294705 A1* 10/2017 Khripkov ..... H01Q 21/24

FOREIGN PATENT DOCUMENTS

CN 108808214 A1 11/2018

OTHER PUBLICATIONS

PCT search report dated Aug. 1, 2019 by SIPO in related PCT Patent Application No. PCT/CN2019/087448 (4 Pages).

* cited by examiner

*Primary Examiner* — Jimmy T Vu

(74) *Attorney, Agent, or Firm* — W&G Law Group LLP

(57) ABSTRACT

A mobile terminal includes a metal frame, and the metal frame includes two corners provided diagonally. The antenna system includes four SIW horn antenna arrays formed on the metal frame. The circumference side of each corner is respectively provided with two SIW horn antenna arrays arranged perpendicular to each other and one of the SIW horn antenna arrays is provided at an end of the long frame close to the connected corner, and the other SIW horn antenna array is provided at an end of the short frame close to the connected corner. The SIW horn antenna array includes multiple SIW horns. The metal frame is provided with multiple spaced through holes at positions corresponding to the SIW horns. The antenna system and the mobile terminal of the present disclosure have good overall coverage efficiency.

10 Claims, 7 Drawing Sheets

ANTENNA SYSTEM AND MOBILE TERMINAL

TECHNICAL FIELD

The present disclosure relates to the field of wireless communication technologies, and in particular, to an antenna system and a mobile terminal.

BACKGROUND

With 5G being the focus of research and development in the global industry, developing 5G technologies and formulating 5G standards have become the industry consensus. The ITU-RWP5D 22nd meeting held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. The high carrier frequency and large bandwidth characteristics unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are caused to distribute according to certain regularity by a phase shifter, so that a high gain beam is formed and the beam is scanned over a certain spatial range through a change in phase shift.

The metal frame architecture is the mainstream solution in mobile phone structural design, providing better protection, aesthetics, thermal dissipation and user experience. However, due to the shielding effect of metal on electromagnetic waves, the radiation performance of the upper and lower antennas will be seriously affected, and the gain of the antenna will be reduced.

Therefore, it is necessary to provide a new antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
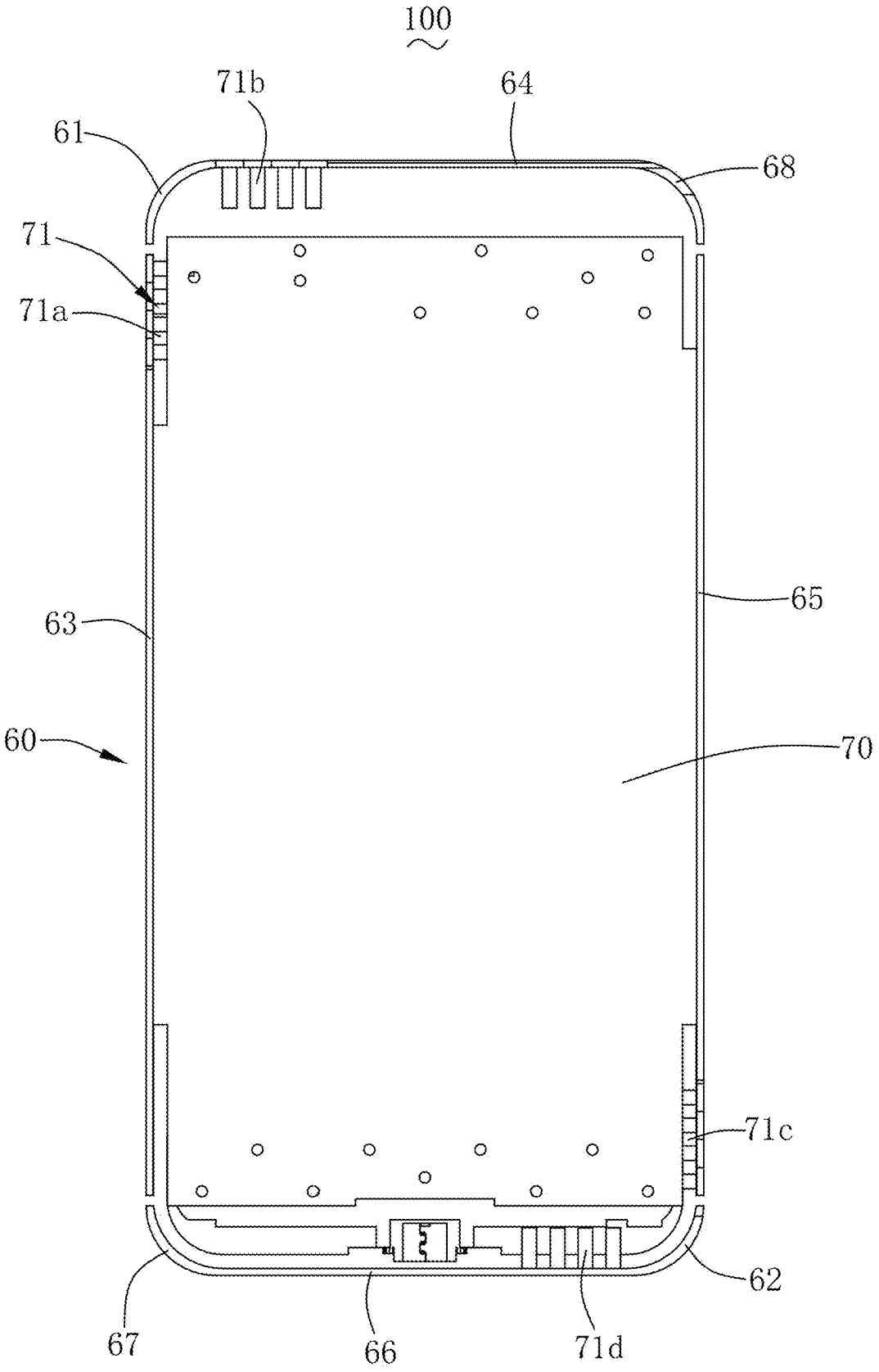
FIG. 1 is a schematic diagram of a layout of an antenna system in a mobile terminal of the present disclosure.
Figure 2:
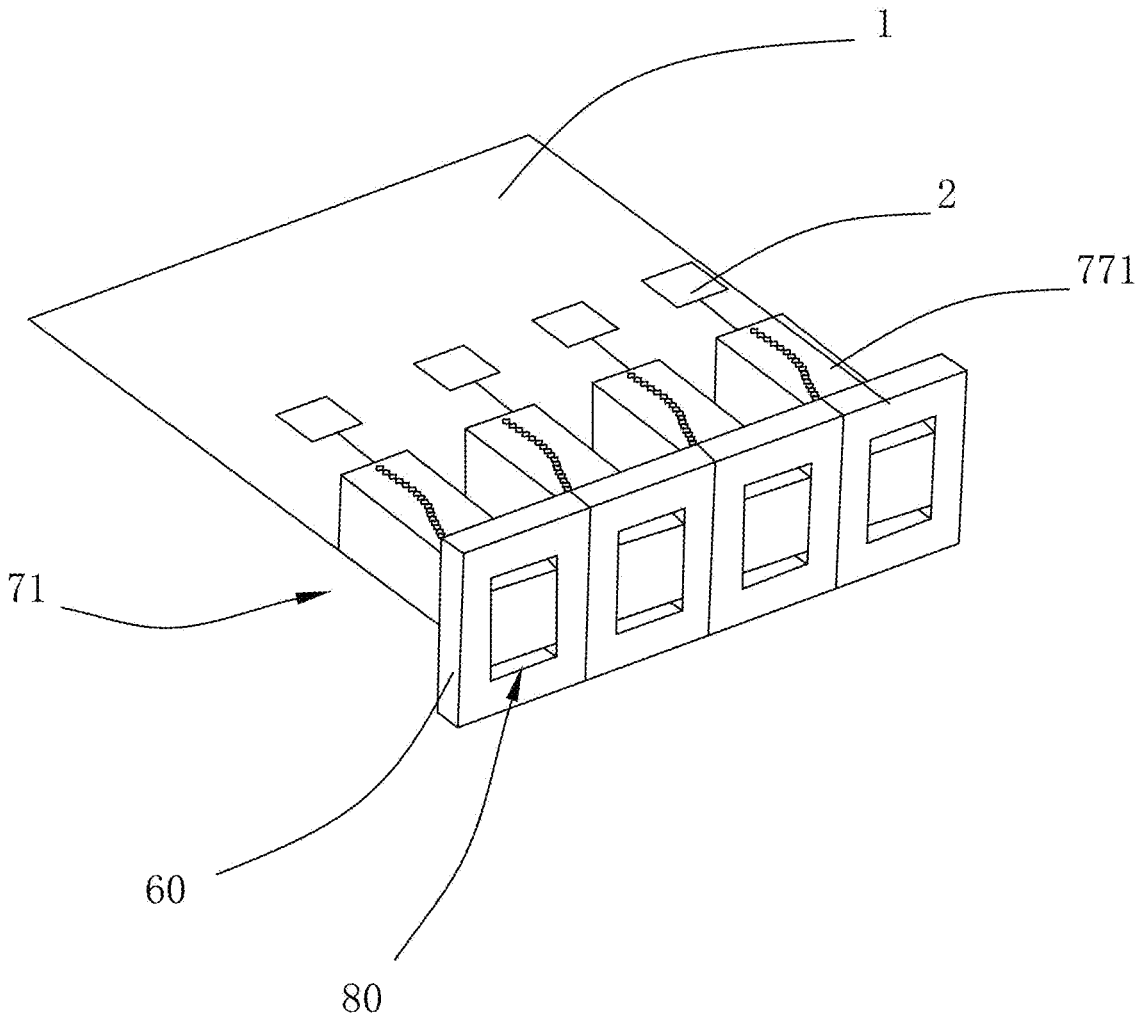
FIG. 2 is a structural schematic diagram of a SIW horn antenna array in the mobile terminal shown in FIG. 1.
Figure 3:
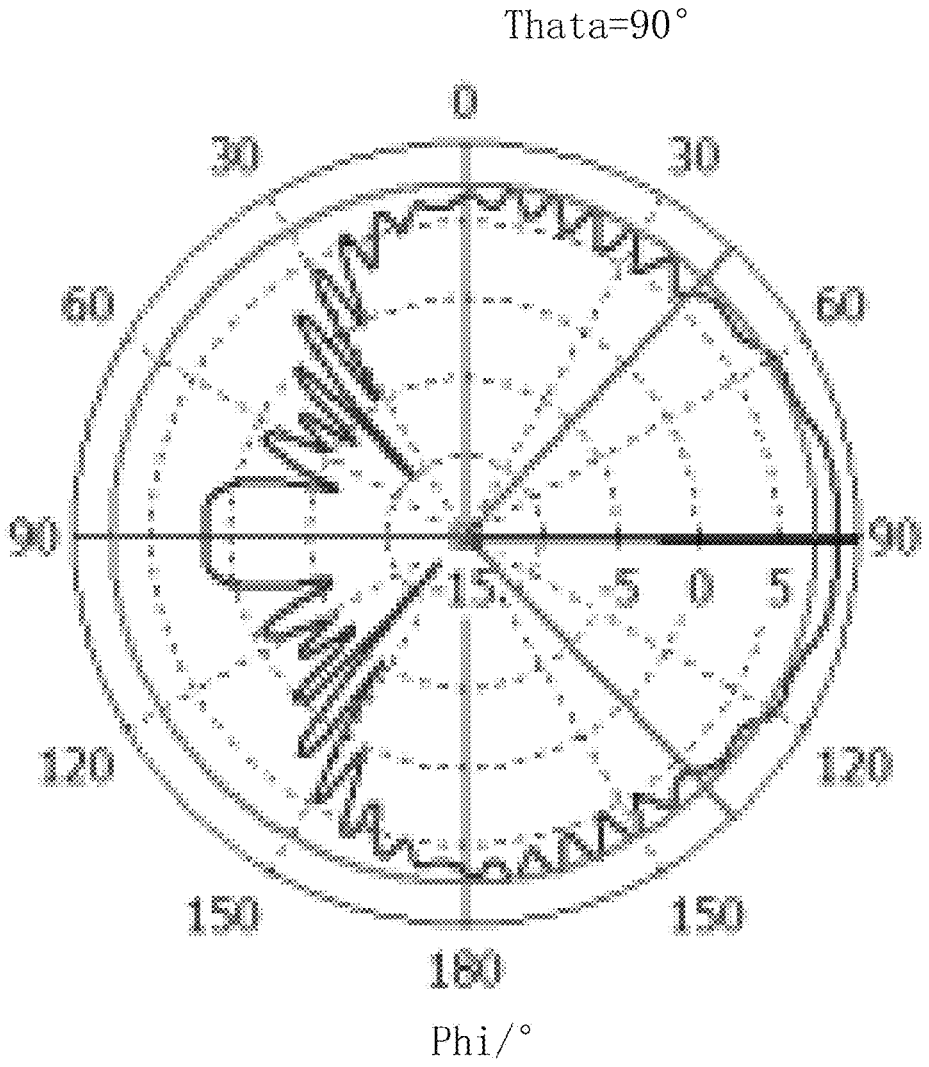
FIG. 3 illustrates a pattern of a first SIW horn antenna array in the mobile terminal shown in FIG. 1 with a phase shift of each SIW horn being 0.
Figure 4:
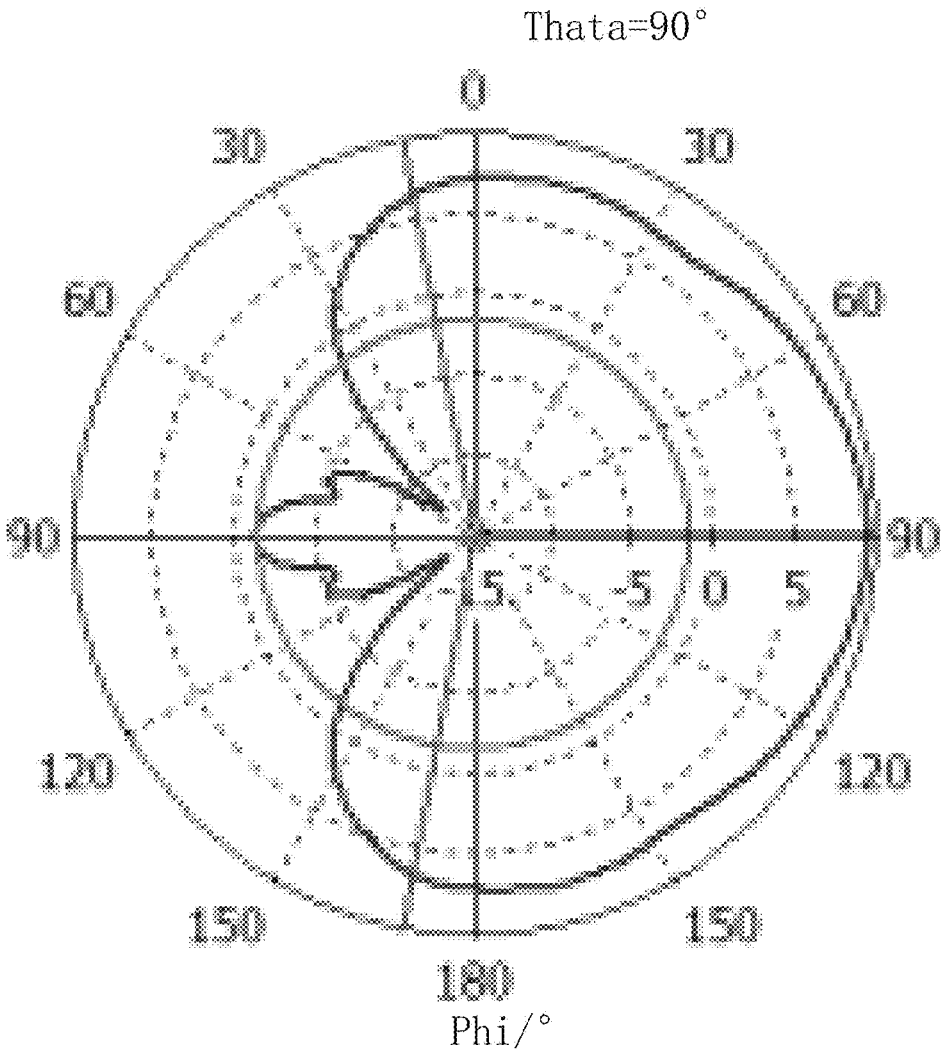
FIG. 4 illustrates a pattern of a second SIW horn antenna array in the mobile terminal shown in FIG. 1 with a phase shift of each SIW horn being 0.
Figure 5:
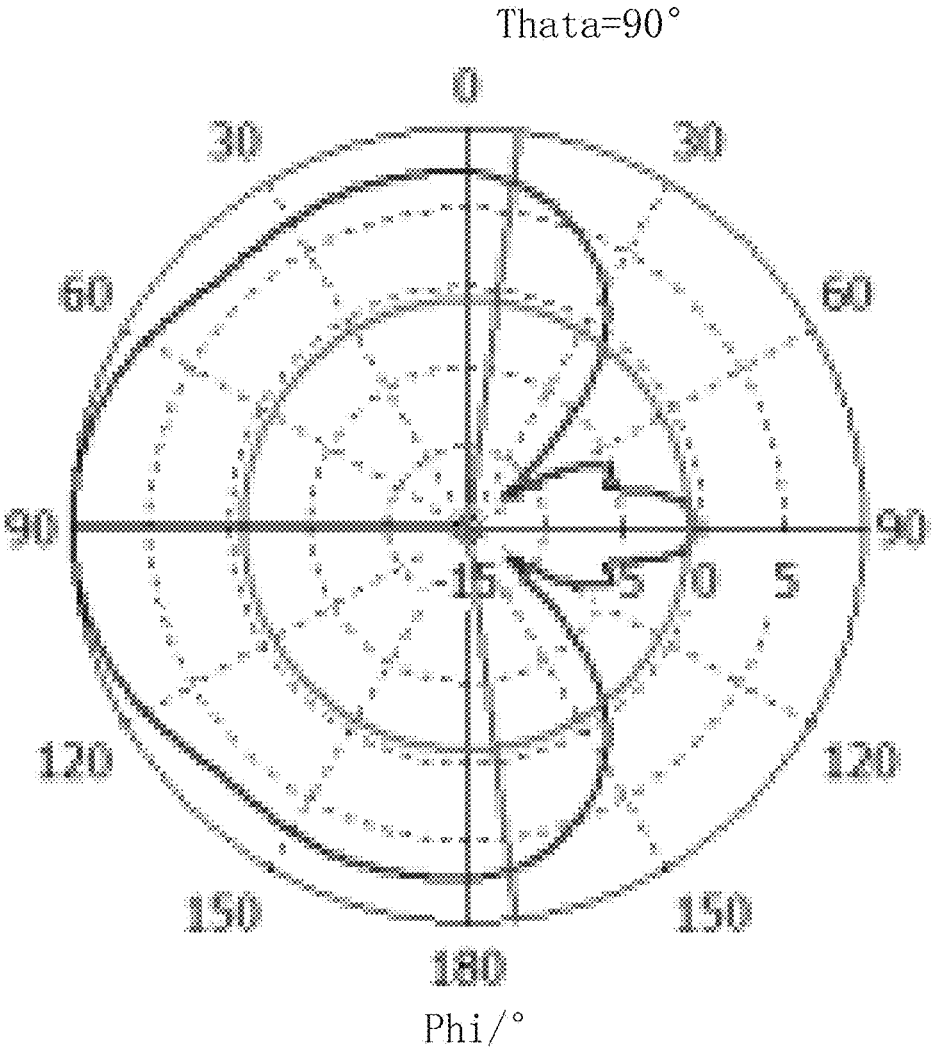
FIG. 5 illustrates a pattern of a third SIW horn antenna array in the mobile terminal shown in FIG. 1 with a phase shift of each SIW horn being 0.
Figure 6:
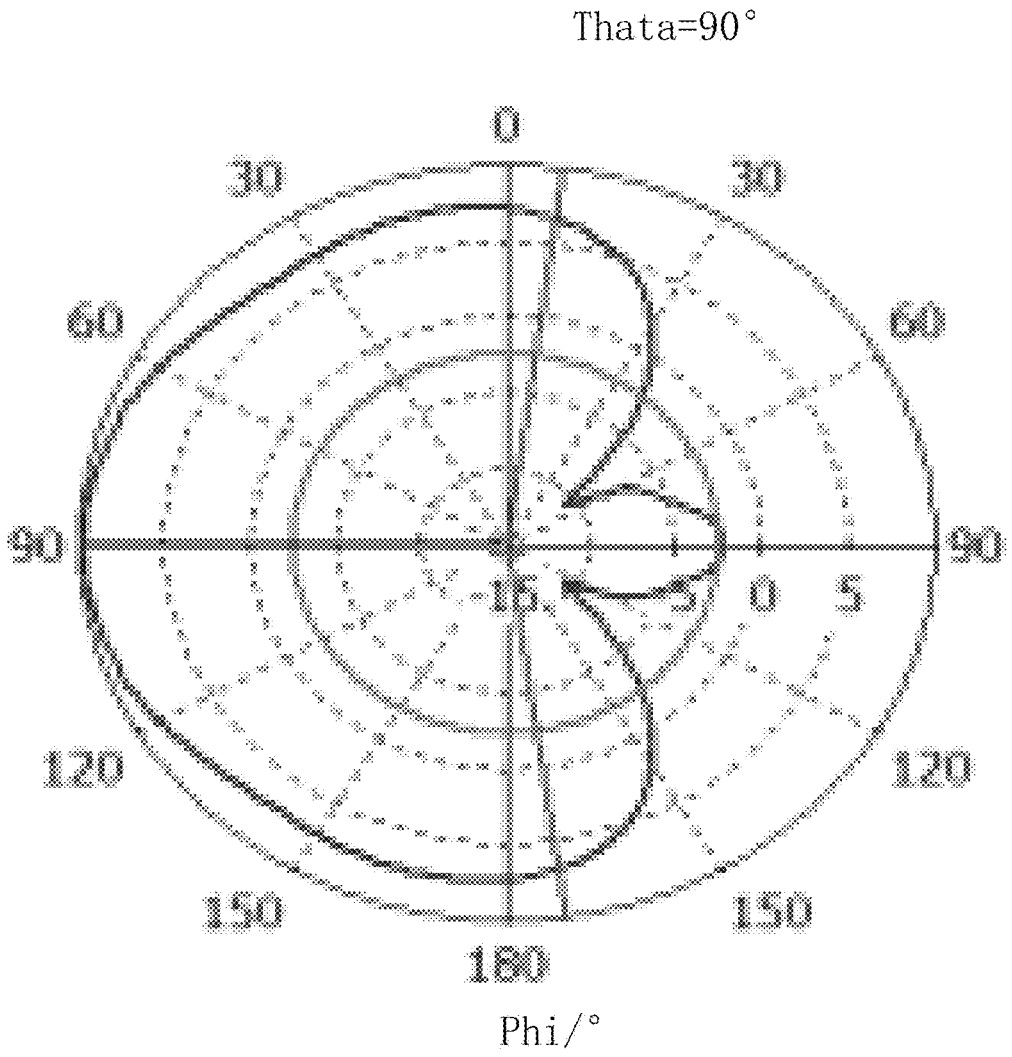
FIG. 6 illustrates a pattern of a fourth SIW horn antenna array in the mobile terminal shown in FIG. 1 with a phase shift of each SIW horn being 0.

Referring to FIGS. 1-2 in conjunction, the present disclosure provides a mobile terminal 100, and the mobile terminal may be a mobile phone, a tablet computer, a multimedia player, etc., which is not limited by the present disclosure. The mobile terminal includes a metal frame 60, a main board 70 received in the metal frame 60 and connected to the metal frame 60, an antenna system disposed inside the metal frame 60, and multiple through holes 80 provided in the metal frame 60. The antenna system can receive and transmit electromagnetic wave signals, thereby achieving a communication function of the mobile terminal.

The metal frame 60 includes a first corner 61 and a second corner 62 disposed diagonally, a first long frame 63 and a first short frame 64 that are respectively connected to two ends of the first corner 61, a second long frame 65 and a second short frame 66 that are respectively connected to two ends of the second corner 62. The first long frame 63 and the second long frame 65 are arranged opposite to each other. The first short frame 64 and the second short frame 66 are arranged opposite to each other. The first long frame 63 and the first short frame 64 are connected by the first corner 61. The second long frame 65 and the second short frame 66 are connected by the second corner 62. The first long frame 63 and the second short frame 66 are connected by a third corner 67 that is on the same side as the first corner 61. The second long frame 65 and the first short frame 64 are connected by a fourth corner 68 that is at the same end as the first corner 61.

In this embodiment, the first corner 61 is located at an upper left corner of the mobile terminal 100. The second corner 62 is located at a lower right corner of the mobile terminal 100. The third corner 67 is located at a lower left corner of the mobile terminal 100. The fourth corner 68 is located at an upper right corner of the mobile terminal. The upper left corner, the lower right corner, the lower left corner, and the upper right corner above are all shown by being viewed in the perspective of FIG. 1.

The antenna system includes four SIW horn antenna arrays 71 formed on the metal frame 60, i.e., a first SIW horn antenna array 71*a*, a second SIW horn antenna array 71*b*, a third SIW horn antenna array 71*c*, and a fourth SIW horn antenna array 71*d*. Specifically, the circumferential sides of the first corner 61 and the second corner 62 are respectively provided with two SIW horn antenna arrays arranged perpendicular to each other. The first SIW horn antenna array 71*a* is provided at an end of the first long frame 63 close to the first corner 61. The second SIW horn antenna array 71*b* is provided at an end of the first short frame 64 close to the first corner 61. The third SIW horn antenna array 71*c* is provided at an end of the second long frame 65 close to the second corner 62. The fourth SIW horn antenna array 71*d* is provided at one end of the second short frame 66 close to the second corner 62. The mobile terminal 100 has a top and a bottom, and the top and bottom are arranged opposite to each other along a length direction of the mobile terminal 100. Four SIW horn antenna arrays are densely distributed on the frame at the corners at the top and bottom of the mobile terminal, thereby reducing the line loss from the RF front end (RFFE) to the antenna unit.

Referring to FIG. 2 in conjunction, each of the SIW horn antenna arrays 71 includes multiple SIW horns 711 provided inside the metal frame 60 and multiple phase shifters 2 electrically connected to the multiple SIW horns 711, respectively. The multiple SIW horns 711 are arranged in a linear array along a circumferential direction of the metal frame 60 instead of a plane array, occupying a small space and only one perspective needs to be scanned, which simplifies design difficulty, test difficulty, and beam management complexity; on the other hand, wide coverage at non-scanning angles is achieved by providing an antenna with a wide beam in non-scanning directions.

In this embodiment, the SIW horn antenna array 71 operates in a millimeter wave band.

In the present embodiment, specifically, each of the SIW horn antenna arrays 71 includes four SIW horns 711 and four phase shifters 2 electrically connected to the four SIW horns 711, respectively. The four SIW horns of the first SIW horn antenna array 71*a* are arranged in an array along a direction parallel to the first long frame 63. The four SIW horns of the second SIW horn antenna array 71*b* are arranged in an array along a direction parallel to the first short frame 64. The four SIW horns of the third SIW horn antenna array 71*c* are arranged in an array along a direction parallel to the second long frame 65. The four SIW horns of the fourth SIW horn antenna array 71*d* are arranged in an array along a direction parallel to the second short frame 66.

The phase shifter 2 has a specification of 5 bits and the phase shift accuracy thereof is 11.25°.

The metal frame 60 is provided with multiple spaced through holes 80 at positions corresponding to the SIW horns 711, and the through hole 80 penetrates the outer surface and the inner surface of the metal frame 60. Each of the SIW horns 711 is fixedly clamped in one of the through holes 80 correspondingly and electrically connected to the metal frame 60. In view of the aesthetics of the mobile terminal 100, it is necessary to minimize the gap between the SIW horn 711 and the through hole 80.

In this embodiment, the through hole 80 has a rectangular shape, and the cross sectional area of the SIW horn 711 is 2×3 mm. The through hole 211 has a cross sectional area of 2×3.5 mm. Without doubt, the shape of the through hole 80 is not limited thereto, and may be a circular, elliptical or the like, all of which are possible.

The antenna system further includes a system ground unit 1, and the system ground unit 1 is directly provided on the main board 80. The system ground unit feeds the SIW horn antenna array with power through the SIW horn, and this feeding mode can achieve direct connection between the SIW horn 711 and the system ground unit 1, which is advantageous for integration.

Based on the above structure, referring to FIG. 3 to FIG. 6, FIG. 3 to FIG. 6 respectively illustrates patterns of the four SIW horn antenna arrays of the antenna system of the present disclosure with a phase shift of each SIW horn being 0. Omni-directional radiation of the antenna system can be achieved by cooperation of the four SIW horn antenna arrays.

Figure 7:
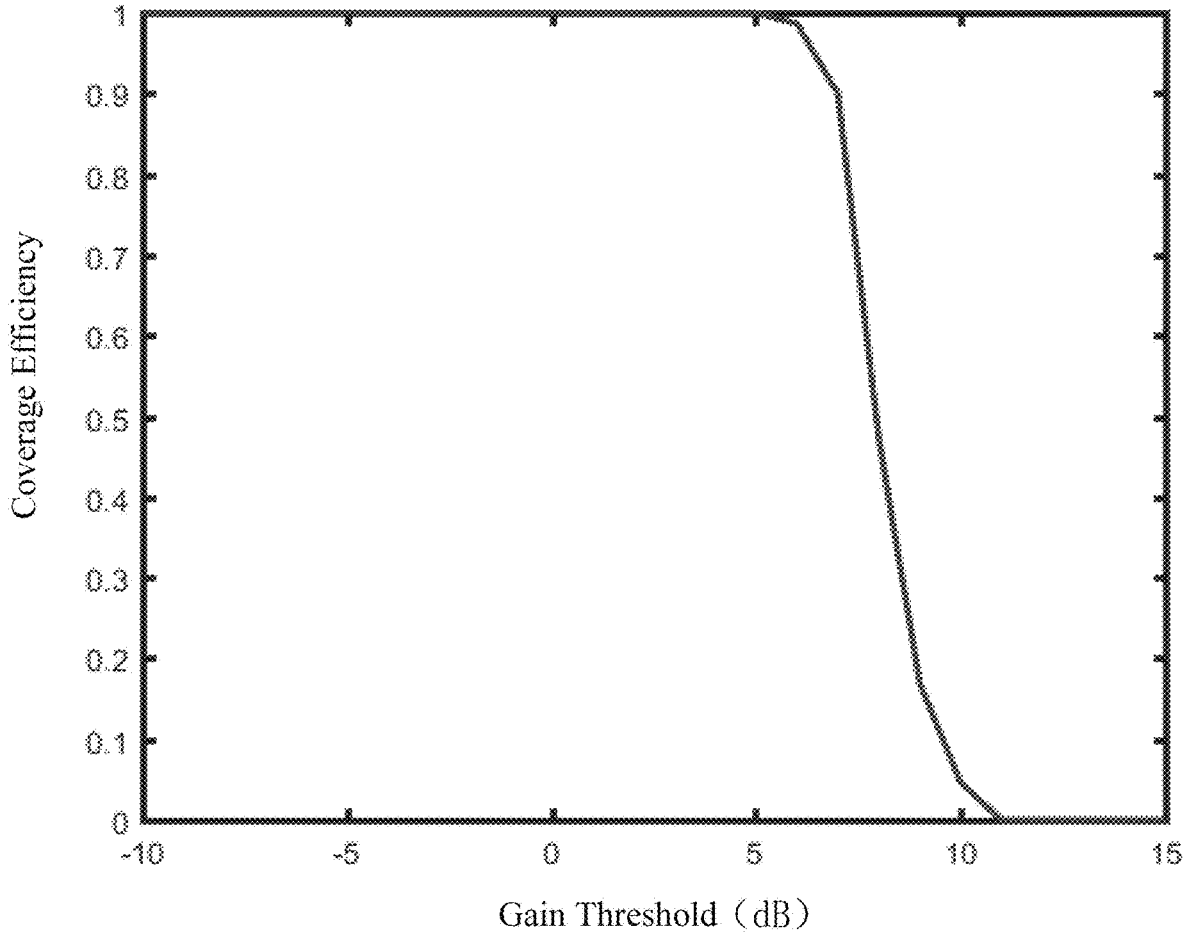
FIG. 7 illustrates a coverage efficiency graph of an antenna system provided by the present disclosure.

FIG. 7 illustrates a coverage efficiency graph of the antenna system provided by the present disclosure. When the gain threshold is 5 dB, the coverage efficiency is close to 1. Namely, the antenna system can achieve beam coverage of 5 dB almost in omni-directional space, which indicates that the antenna system provided by the present disclosure has good overall coverage efficiency.

Compared with the related art, the antenna system and the mobile terminal provided by the present disclosure have the following beneficial effects:

1. The four arrays of antennas of the antenna system cooperate with each other to achieve beam coverage of 5 dB in the omni-directional space, such that the antenna system has good overall coverage efficiency, thereby improving the stability of the signal of the mobile terminal;

2. The antenna system is provided on the metal frame of the mobile terminal, which saves the internal space of the mobile terminal;

3. The antenna system adopts the SIW structure for feeding power, such that direct connection between the antenna and the main board can be achieved, which is beneficial for integration;

4. The antenna system adopts a linear array, occupies a small space and only one perspective needs to be scanned, which simplifies design difficulty, test difficulty, and beam management complexity;

5. The four arrays of antennas of the antenna system are densely distributed on the frame at the corners of the mobile terminal, which reduces the line loss from the RF front end to the antenna unit and improves the receiving efficiency.

What have been described above are only embodiments of the present disclosure, and it should be noted herein that one ordinary person skilled in the art can make improvements without departing from the inventive concept of the present disclosure, but these are all within the scope of the present disclosure.

What is claimed is:

1. An antenna system, applied to a mobile terminal comprising a metal frame, the metal frame comprising two corners provided diagonally, and two long frames and two short frames respectively connected to two ends of the two corners, the two long frames respectively connected to the two corners are arranged opposite to each other, and the two short frames respectively connected to the two corners are arranged opposite to each other, wherein the antenna system comprises:

four SIW horn antenna arrays formed on the metal frame, for each of the two corners, two of the four SIW horn antenna arrays arranged perpendicular to each other are provided around the corner, and one of the two SIW horn antenna arrays is provided at an end of one of the two long frames connected to the corner and close to the corner, and the other one of the two SIW horn antenna arrays is provided at an end of one of the two short frames connected to the corner and close to the corner, each of the four SIW horn antenna arrays comprises a plurality of SIW horns provided inside the metal frame, the metal frame is provided with a plurality of through holes spaced at intervals at positions corresponding to the plurality of SIW horns, each of the plurality of SIW horns is correspondingly clamped in one of the plurality of through holes and electrically connected to the metal frame, and each of the plurality of through holes has a larger cross sectional area than a corresponding one of the plurality of SIW horns.

2. The antenna system as described in claim 1, wherein each of the plurality of through holes is rectangular.

3. The antenna system as described in claim 2, wherein each of the plurality of SIW horns has a cross sectional area of 2×3 mm, and each of the plurality of through holes has a cross sectional area of 2×3.5 mm.

4. The antenna system as described in claim 1, wherein each of the four SIW horn antenna arrays further comprises a plurality of phase shifters, and a number of the plurality of phase shifters is identical to a number of the plurality of SIW horns, and each of the plurality of SIW horns is correspondingly connected to a corresponding one of the plurality of phase shifters.

5. The antenna system as described in claim 4, wherein each of the plurality of phase shifters has a specification of 5 bits and a phase shift accuracy of 11.25°.

6. The antenna system as described in claim 1, wherein the four SIW horn antenna arrays operate in a millimeter wave band.

7. The antenna system as described in claim 1, further comprising a system ground unit configured to feed the four SIW horn antenna arrays with power through the plurality of SIW horns.

8. The antenna system as described in claim 1, wherein the mobile terminal has a rectangular structure, two of the four SIW horn antenna arrays are provided in an upper left corner of the mobile terminal and the other two of the four SIW horn antenna arrays are provided at a lower right corner of the mobile terminal.

9. The antenna system as described in claim 1, wherein each of the four SIW horn antenna arrays is a 1×4 linear array antenna.

10. A mobile terminal, comprising the antenna system as described in claim 1.

* * * * *